US007729635B2

(12) United States Patent
Okoshi et al.

(10) Patent No.: US 7,729,635 B2
(45) Date of Patent: Jun. 1, 2010

(54) IMAGE FORMING APPARATUS INCLUDING MOVEMENT MECHANISM

(75) Inventors: Takeshi Okoshi, Saitama (JP); Naomasa Okimura, Saitama (JP); Yukinori Sezaki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 890 days.

(21) Appl. No.: 11/398,624

(22) Filed: Apr. 6, 2006

(65) Prior Publication Data

US 2007/0065175 A1 Mar. 22, 2007

(30) Foreign Application Priority Data

Sep. 22, 2005 (JP) ..... P2005-274965

(51) Int. Cl.
*G03G 21/16* (2006.01)

(52) U.S. Cl. ..... 399/110

(58) Field of Classification Search ..... 399/110, 399/113

See application file for complete search history.

(56) References Cited

U.S. PATENT DOCUMENTS 4,862,212 A * 8/1989 Tanzawa et al. ..... 399/110
5,398,098 A * 3/1995 Fukunaga et al. ..... 399/110
5,587,769 A * 12/1996 Sawada et al. ..... 399/113

FOREIGN PATENT DOCUMENTS

JP 2003-295562 A 10/2003

* cited by examiner

*Primary Examiner*—David M Gray
*Assistant Examiner*—Andrew V Do
(74) *Attorney, Agent, or Firm*—Sughrue Mion, PLLC

(57) ABSTRACT

An image forming apparatus includes an image forming apparatus body, a first unit detachably attached to the image forming apparatus body, a second unit detachably attached to the image forming apparatus body; and a movement mechanism that moves at least one of the first unit and the second unit to satisfy the condition that each of the first unit and the second unit is disposed not to hinder the other from being attached to and detached from the image forming apparatus body.

15 Claims, 13 Drawing Sheets

IMAGE FORMING APPARATUS INCLUDING MOVEMENT MECHANISM

BACKGROUND OF THE INVENTION

1. Field of the Invention

The present invention relates to an image forming apparatus.

2. Related Art

There is a known related technique of adapting an image forming apparatus, such as a copying machine, a facsimile, and a printer, which has a first unit, for example, a process cartridge, and a second unit, for instance, a developer container, so that the first unit and the second unit can be attached to and detached from an image forming apparatus body as shown in JP-A-2003-295562.

However, to enable the first unit and the second unit to be separately attached to and detached from the image forming apparatus body, the related technique is subject to a constraint that each of the first unit and the second unit should be disposed not to hinder the other from being attached to and detached from the image forming apparatus body. Consequently, the related technique has a problem that an image forming apparatus is enlarged according to the related art due to this constraint.

SUMMARY OF THE INVENTION

The present invention has been made in view of the above circumstances and to provide a miniaturizable image forming apparatus.

According to the invention, there is provided an image forming apparatus that comprises an image forming apparatus body, a first unit to be attached to and detached from the image forming apparatus body, a second unit to be attached to and detached from the image forming apparatus body, and a movement mechanism that moves at least one of the first unit and the second unit so that each of the first unit and the second unit is disposed not to hinder the other from being attached to and detached from the image forming apparatus body. Thus, at least one of the first unit and the second unit can be moved by the movement mechanism so that each of the first unit and the second unit is disposed not to hinder the other from being attached to and detached from the image forming apparatus body. This removes constraint imposed on the layout of the first unit and the second unit in the image forming apparatus body. Consequently, the image forming apparatus can be miniaturized.

Preferably, the second unit is connected to the first unit. The movement mechanism moves at least one of the first unit and the second unit, and disconnects the second unit from the first unit.

Preferably, an opening portion used to attach and detach at least one of the first unit and the second unit to and from the image forming apparatus body is provided in the image forming apparatus body. The opening portion is provided with an opening/closing cover. The movement mechanism cooperates with opening of the opening/closing cover. Thus, the movement mechanism can be cooperated with a simple operation of opening the opening/closing cover.

Preferably, the second unit is connected to the first unit. The movement mechanism moves at least a part of the second unit to a position at which the part of the second unit is drawn out of the image forming apparatus body, after cooperating the second unit with opening of the opening/closing cover to thereby disconnect the second unit from the first unit. Thus, both of the disconnection between the second unit and the first unit, and the movement of the second unit are achieved by a simple operation of opening the opening/closing cover.

Preferably, the second unit is disposed so that a longitudinal direction of the second unit is substantially perpendicular to a longitudinal direction of the first unit. The movement mechanism causes the second unit to turn around a support portion provided at the image forming apparatus body so that an end portion of the second unit, which portion is provided at the side of the first unit, is placed outside one end portion and the other end portion in the longitudinal direction of the first unit. Thus, the second unit can easily be taken out of the image forming apparatus body from the side of the end portion of the second unit, which portion is provided at the side of the first unit and is placed outside the one end portion and the other end portion in the longitudinal direction of the first unit.

Preferably, the second unit is disposed so that a longitudinal direction of the second unit is substantially perpendicular to a longitudinal direction of the first unit. The movement mechanism causes the second unit to move in the longitudinal direction of the first unit so that no part of the second unit is present between one end portion and the other end portion in the longitudinal direction of the first unit. Thus, the second unit can easily be taken out of the image forming apparatus body, because no part of which portion is placed between the one end portion and the other end portion in the longitudinal direction of the first unit.

Preferably, a direction, in which the first unit is taken out of the image forming apparatus body, is substantially the same as that in which the second unit is taken out of the image forming apparatus body.

Preferably, the second unit is disposed so that at least a part of the second unit is placed between one end portion and the other end portion in a longitudinal direction of the first unit in a state in which the second unit is mounted in the image forming apparatus body. Thus, the image forming apparatus can be prevented from being enlarged in the longitudinal direction of the first unit.

Preferably, the first unit has a development device. The second unit has a developer accommodating portion in which a developer to be supplied to the development device is accommodated.

Preferably, the first unit has a developer removing device that removes a developer from a surface of an image carrying body. The second unit has a developer collecting portion that collects a developer removed by the developer removing device.

Advantages of the Invention

According to the invention, an image forming apparatus can be miniaturized.

BRIEF DESCRIPTION OF THE DRAWINGS

Preferred embodiment(s) of the present invention will be described in detail based on the following figures wherein.

DETAILED DESCRIPTION OF THE INVENTION

Figure 1:
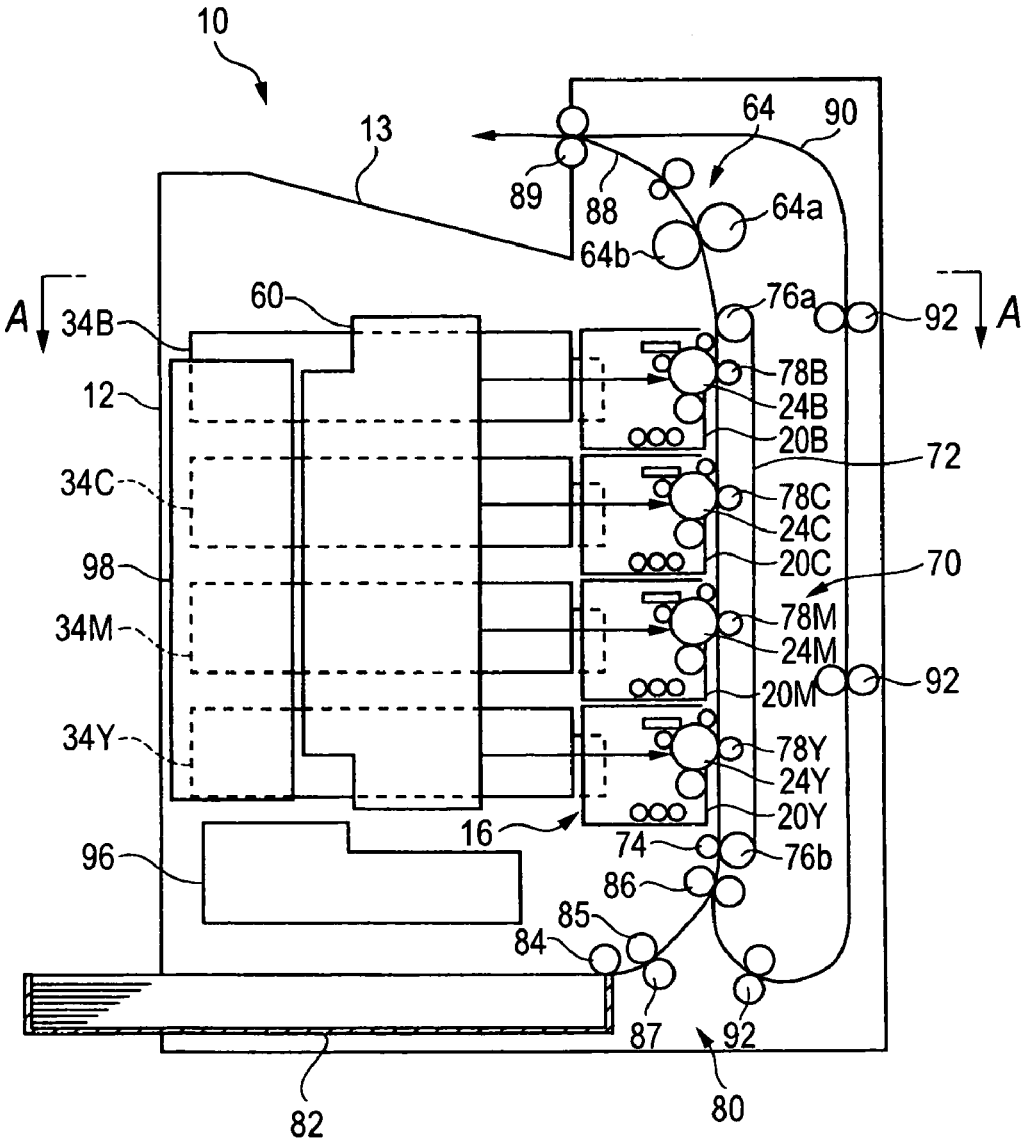
FIG. 1 is a cross-sectional view illustrating the configuration of an image forming apparatus according to a first embodiment of the invention.

Next, an embodiment of the invention is described below with reference to the accompanying drawings.

FIGS. 1 to 11 show an image forming apparatus 10 according to the embodiment of the invention. This image forming apparatus 10 has an image forming apparatus body 12. In this image forming apparatus body 12, an image forming portion 16, a sheet supply/conveyance system 80, a power supply unit 96, a controller 98, and a movement mechanism 100 used as a movement mechanism used to move at least one of a set of image forming units 20Y, 20M, 20C, and 20B, and a set of developer tanks 34Y, 34M, 34C, and 34B are disposed.

Figure 3:
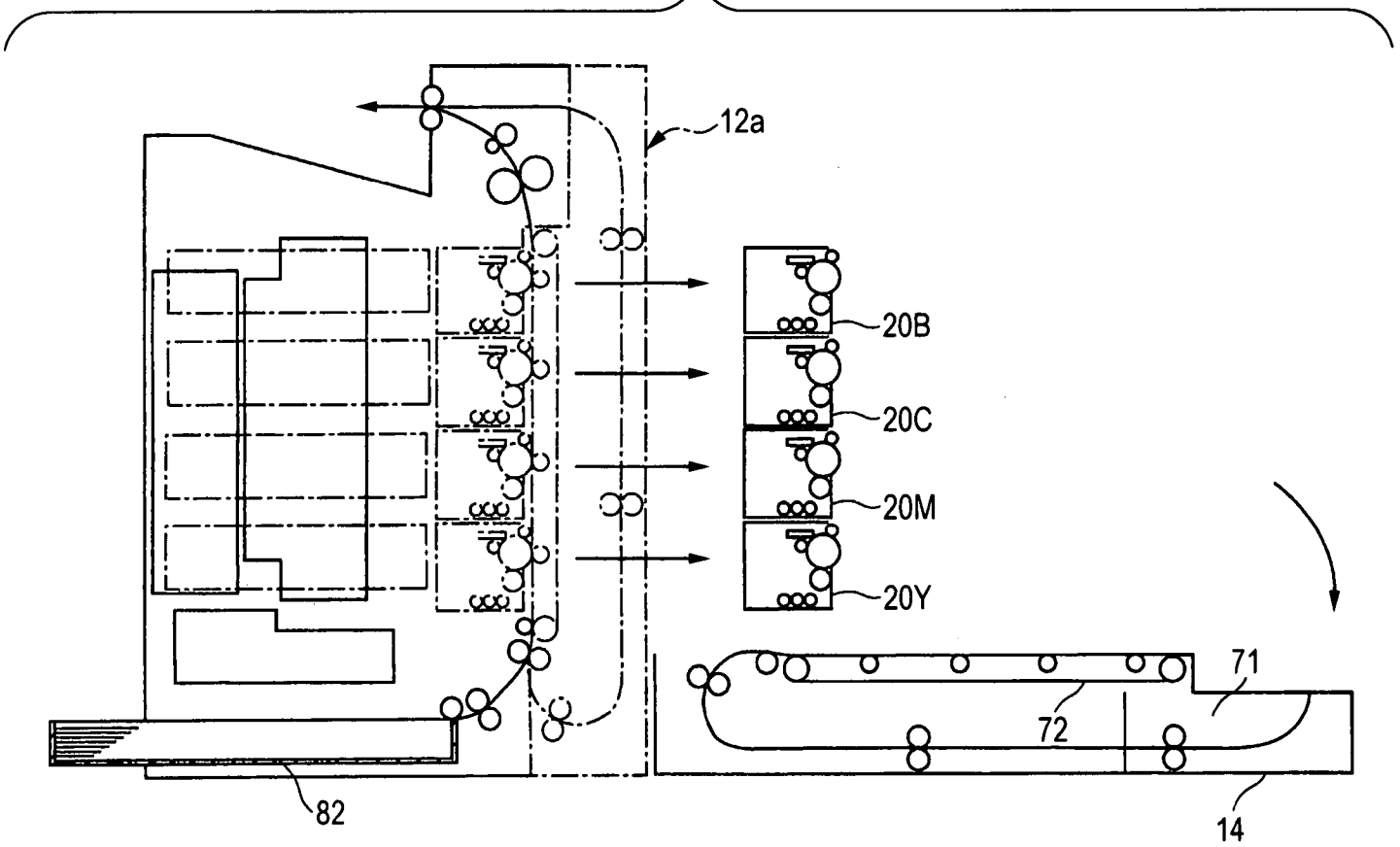
FIG. 3 is an explanatory view illustrating a state in which an image forming unit is taken out of the image forming apparatus according to the first embodiment of the invention.
Figure 4:
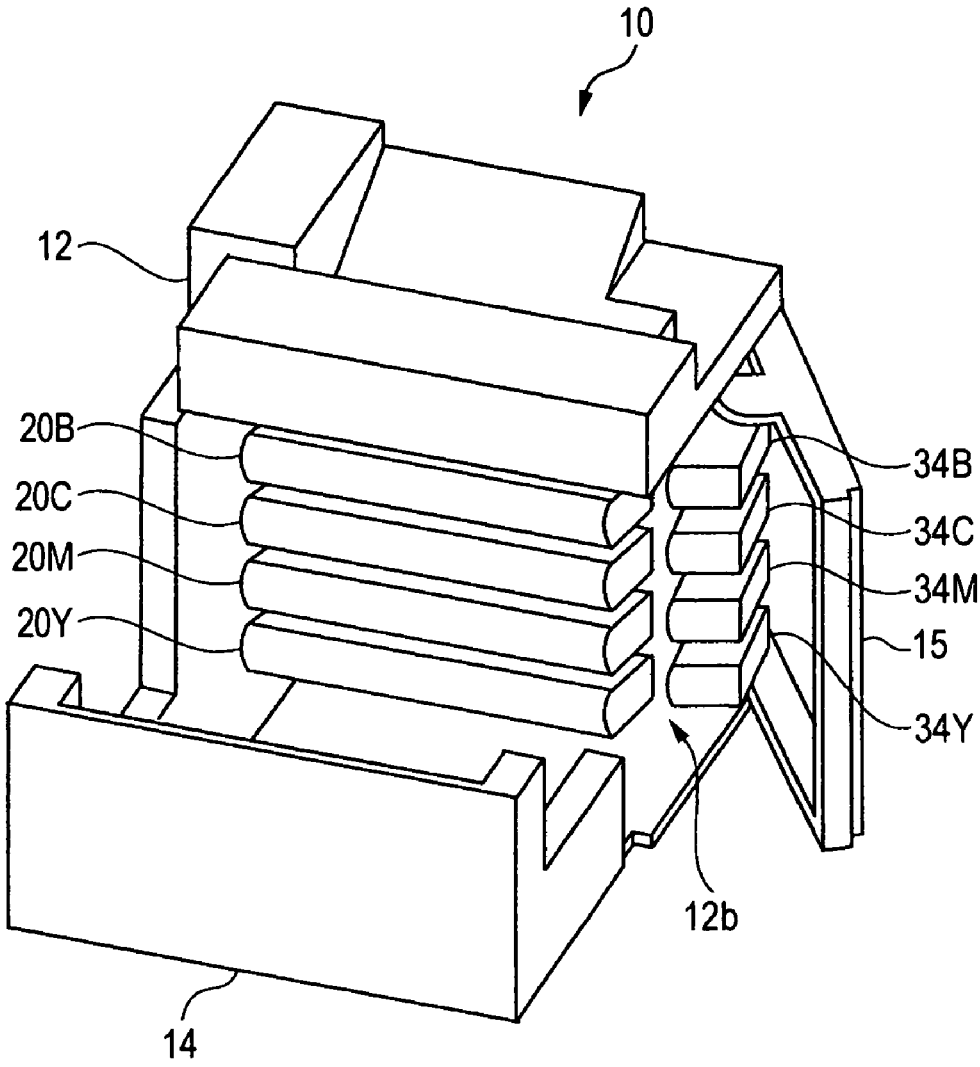
FIG. 4 is a perspective view illustrating a state in which a developer tank is taken out of the image forming apparatus according to the first embodiment of the invention.

The image forming apparatus body 12 is provided with a discharge portion 13 that discharges a sheet on which an image is formed, an opening portion 12*a* provided in a right side as viewed in FIGS. 1 and 3, and an opening portion 12*b* provided in a rear side as viewed in these figures. The opening portion 12*a* is provided with a front cover 14. Each of the image forming units 20Y, 20M, 20C, and 20B (to be described later) are attached to and detached from the image forming apparatus body 12 as a first unit through the opening portion 12*a* in a state in which the front cover 14 shown in FIGS. 3 and 4 is opened.

The opening portion 12*b* is used as an opening part to be used to attach and detach at least one of a set of the image forming units 20Y, 20M, 20C, and 20B and a set of developer tanks 34Y, 34M, 34C, and 34B, each of which is used as a second unit (to be described later), to and from the image forming apparatus body. The opening portion 12*b* is provided with a side cover 15 to be used as an opening/closing cover. Each of the developer tanks 34Y, 34M, 34C, and 34B are attached to and detached from the image forming apparatus body 12 through the opening portion 12*b* in a state in which the side cover 15 shown in FIG. 4 is opened. The side cover 15 cooperates with the movement mechanism 100. The movement mechanism 100 cooperates with opening of the side cover 15. The side cover 15 is described later in detail.

The image forming portion 16 is of the electrophotographic type that forms a color image, and is detachably attached to the image forming apparatus body 12. The image forming portion 16 includes the image forming units 20Y, 20M, 20C, and 20B, which respectively have the development devices 28Y, 28M, 28C, and 28B and are attached to and detached from the image forming apparatus body 12, and also includes the developer tanks 34Y, 34M, 34C, and 34B which accommodate developers to be respectively supplied to the development devices 28Y, 28M, 28C, and 28B and are detachably attached to the image forming apparatus body 12. The image forming portion 16 also includes an optical writing device 60 used as a latent image forming device that uses light to thereby form electrostatic latent images on the photoreceptors 24Y, 24M, 24C, and 24B used as image carrying bodies that the image forming units 20Y, 20M, 20C, and 20B respectively have. The image forming portion 16 also includes a transfer device 70 that transfers developer images, which are respectively formed on the photoreceptors 24Y, 24M, 24C, and 24B, onto a sheet used as an element on which the developer images are transferred, and a fixation device 64 that fixes the developer image, which is transferred by the transfer device 70, onto a sheet.

The image forming unit 20Y is used to form a yellow developer image. The image forming unit 20M is used to form a magenta developer image. The image forming unit 20C is used to form a cyan developer image. The image forming unit 20B is used to form a black developer image. In the image forming apparatus body 12, the image forming units 20, that is, the image forming unit 20Y, the image forming unit 20M, the image forming unit 20C, and the image forming unit 20B are arranged along a conveying belt 72 (to be described later) in an up-down direction in this order. The image forming units 20Y, 20M, 20C, and 20B differ in the color of the developer from one another and have the same structure. Thus, hereinafter, the image forming units are generically referred to as the "image forming unit 20".

Figure 5:
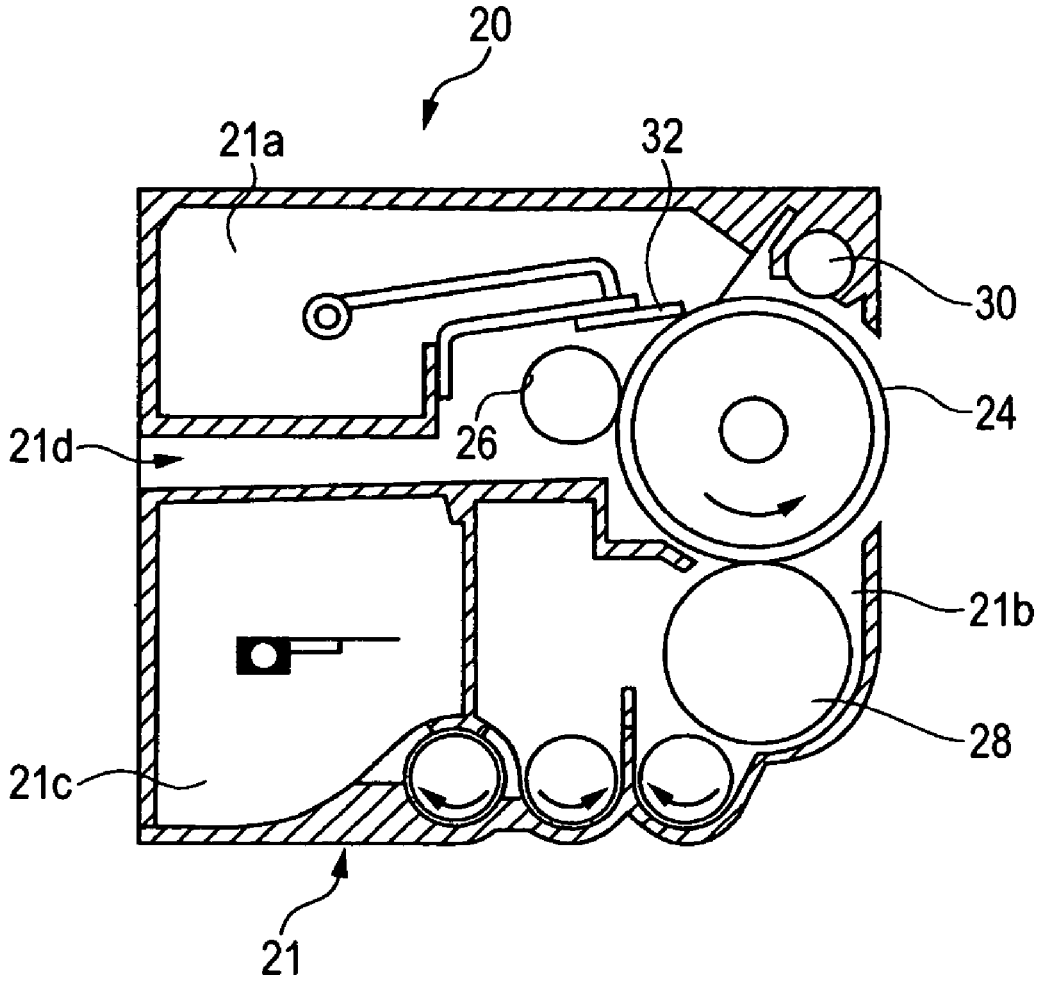
FIG. 5 is a cross-sectional view illustrating the image forming unit of the image forming apparatus according to the first embodiment of the invention.
Figure 7:
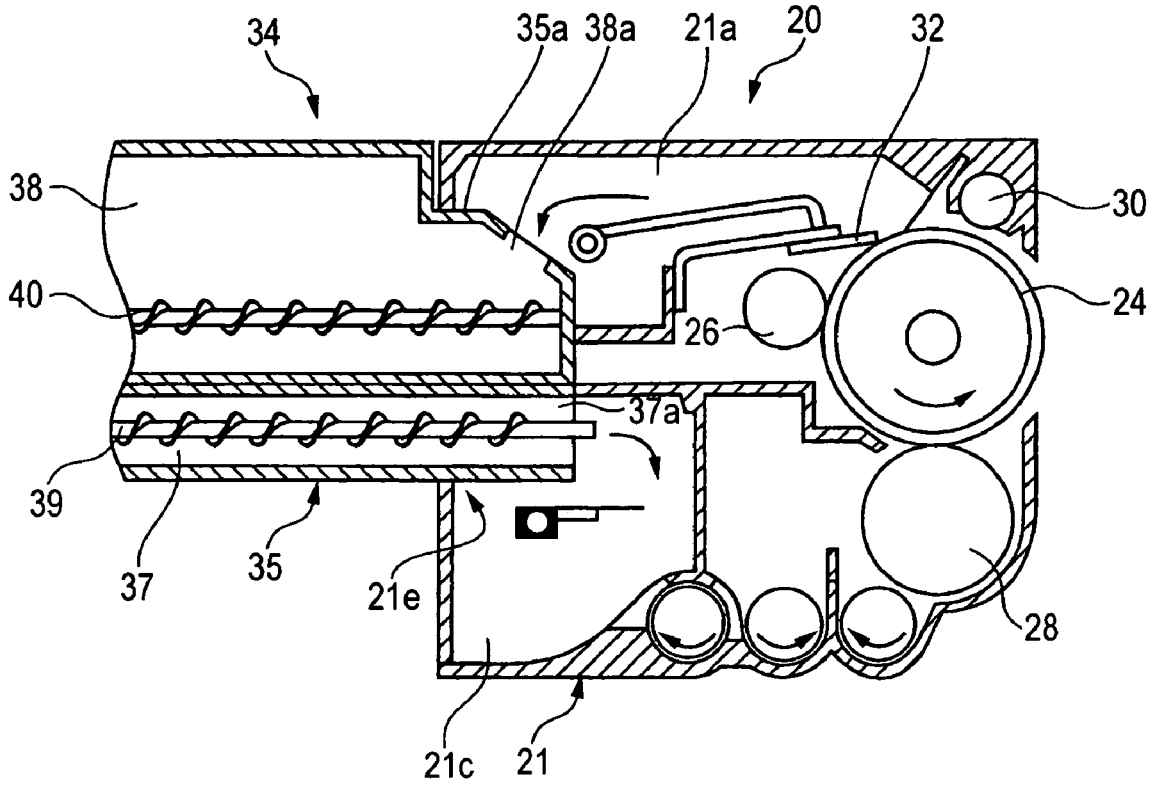
FIG. 7 is a cross-sectional view illustrating a state of connecting the image forming unit and the developer tank, which is the image forming apparatus according to the first embodiment of the invention.
Figure 8:
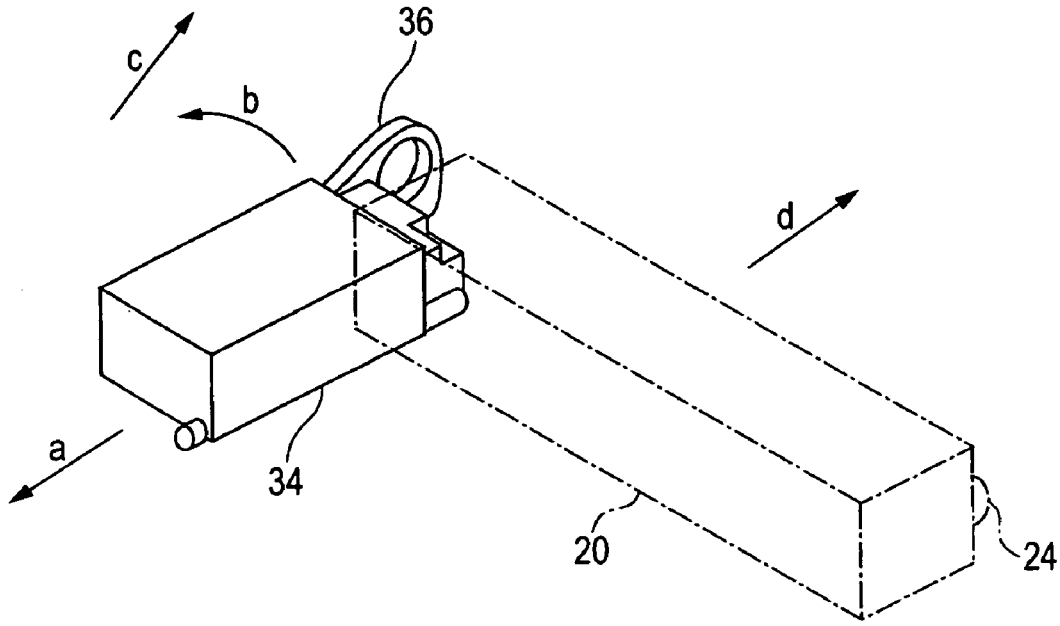
FIG. 8 is an explanatory view illustrating directions in which the image forming unit and the developer tank are respectively taken out of the image forming apparatus according to the first embodiment of the invention.

The image forming unit 20 has an image forming unit casing 21, as shown in FIGS. 5 and 7. The inside of the image forming unit casing 21 is partitioned into a cleaning chamber 21*a*, a development chamber 21*b*, and a developer supply chamber 21*c*. Also, an exposure light path 21*d* through which exposure light outputted from the optical writing device 60 passes is provided therein. Also, an opening portion 21*e* is provided therein to communicate the cleaning chamber 21*a*, the developer supply chamber 21*c*, and the exterior of the image forming unit casing 21 with one another, and is used as a connection portion to be connected to the developer tank 34 (to be described later).

The image forming unit 20 has a drum-shaped photoreceptor 24 used as an image carrying body, an electrification device having an electrification roll uniformly electrifying the photoreceptor 24, the development device that develops the latent image written to the photoreceptor 24 by using a developer, an erase lamp 30 used as a neutralization mechanism that removes electricity from the photoreceptor 24, and the cleaning device 32 used as a developer removing device that removes a developer from the surface of the photoreceptor 24. Thus, the image forming unit 20 develops the latent image, which is written to the photoreceptor 24 by the optical writing device 60 and forms a developer image on the surface of the photoreceptor 24.

The image forming units 20Y, 20M, 20C, and 20B are attached to and detached from the image forming apparatus body 12 through the opening portion 12*a* that is opened by opening the front cover 14, as previously described.

A yellow developer to be supplied to the development device 28Y, a magenta developer to be supplied to the development device 28M, a cyan developer to be supplied to the development device 28C, and a black developer to be supplied to the development device 28B are accommodated in the developer tanks 34Y, 34M, 34C, and 34B, respectively. The developer tanks 34Y, 34M, 34C, and 34B differ in the color of the developer, which is to be accommodated, from one another and have the same structure. Thus, hereinafter, the developer tanks are generically referred to as the developer tank 34.

Figure 6:
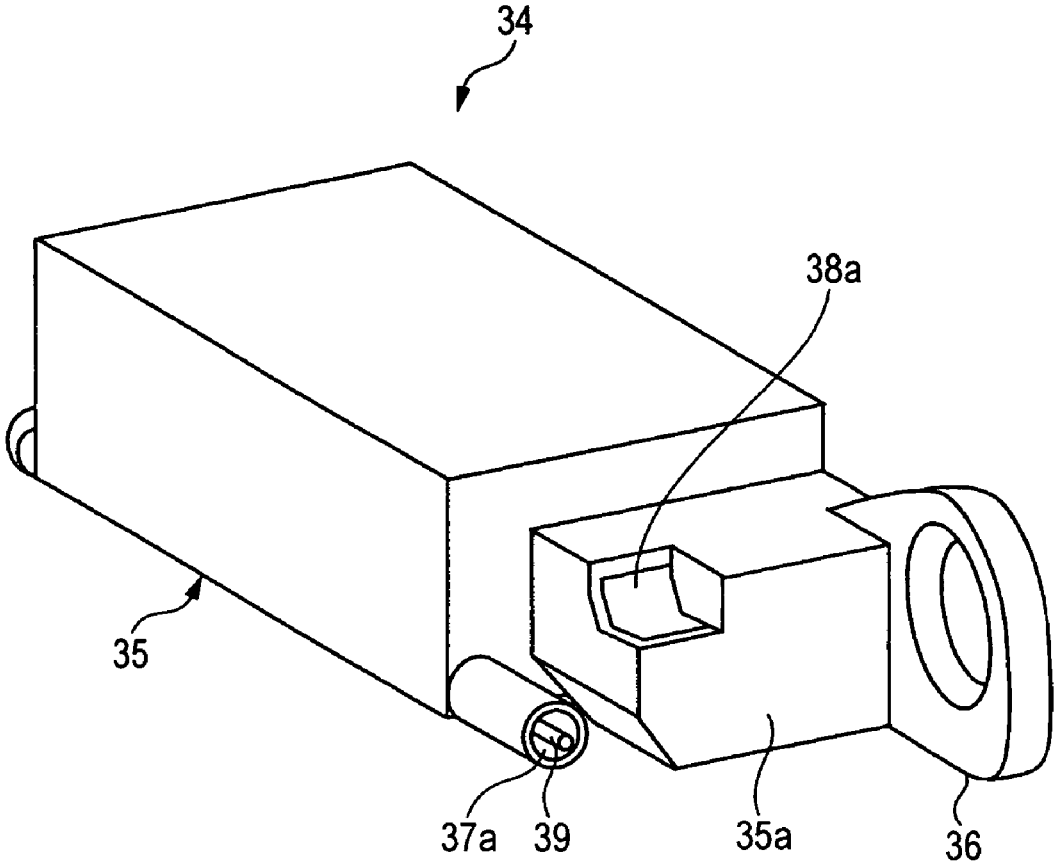
FIG. 6 is an explanatory view illustrating the developer tank of the image forming apparatus according to the first embodiment of the invention.

As shown in FIGS. 6 and 7, the developer tank 34 has a developer tank casing 35. The inside of the developer tank casing 35 is partitioned into a developer supply chamber 37 used as a developer accommodating portion, and into a developer collecting chamber 38 used as a developer collecting portion. Also, as viewed in FIG. 7, a right side portion of the developer tank casing 35 protrudes to thereby form a protrusion portion 35*a* that is used as a connection portion to connect the developer tank 34 to the image forming unit 20. That is, the protrusion portion 35*a* is inserted into the opening portion 21*e* provided in the image forming unit 20, so that the developer tank 34 is connected to the image forming unit 20. Also, the developer tank 34 has a handle 36 used, for example, when the developer tank 34 is attached to and is detached from the image forming apparatus body.

A supply port 37*a* used to communicate the developer supply chamber 21*c* of the aforementioned image forming unit 20 with the developer supply chamber 37 is provided in the developer supply chamber 37. Also, the developer supply chamber 37 has a supply auger 39 used as a supply developer conveying mechanism that conveys a developer to be supplied. A developer is conveyed by the supply auger 39 and is supplied to the developer supply chamber 21*c* through the supply port 37*a*. The developer collecting chamber 38 is provided with a collecting port 38*a* that communicates the cleaning chamber 21*a* of the aforementioned image forming unit 20 with the developer collecting chamber 38. Also, the developer collecting chamber 38 has a collecting auger 40 that conveys a collected developer. The developer removed from the photoreceptor 24 by the aforementioned cleaning device 32 is collected to the developer collecting chamber 38 through the collecting port 38*a*. The collected developer is leftwardly conveyed by the collecting auger 40, as viewed in FIG. 7.

Figure 2:
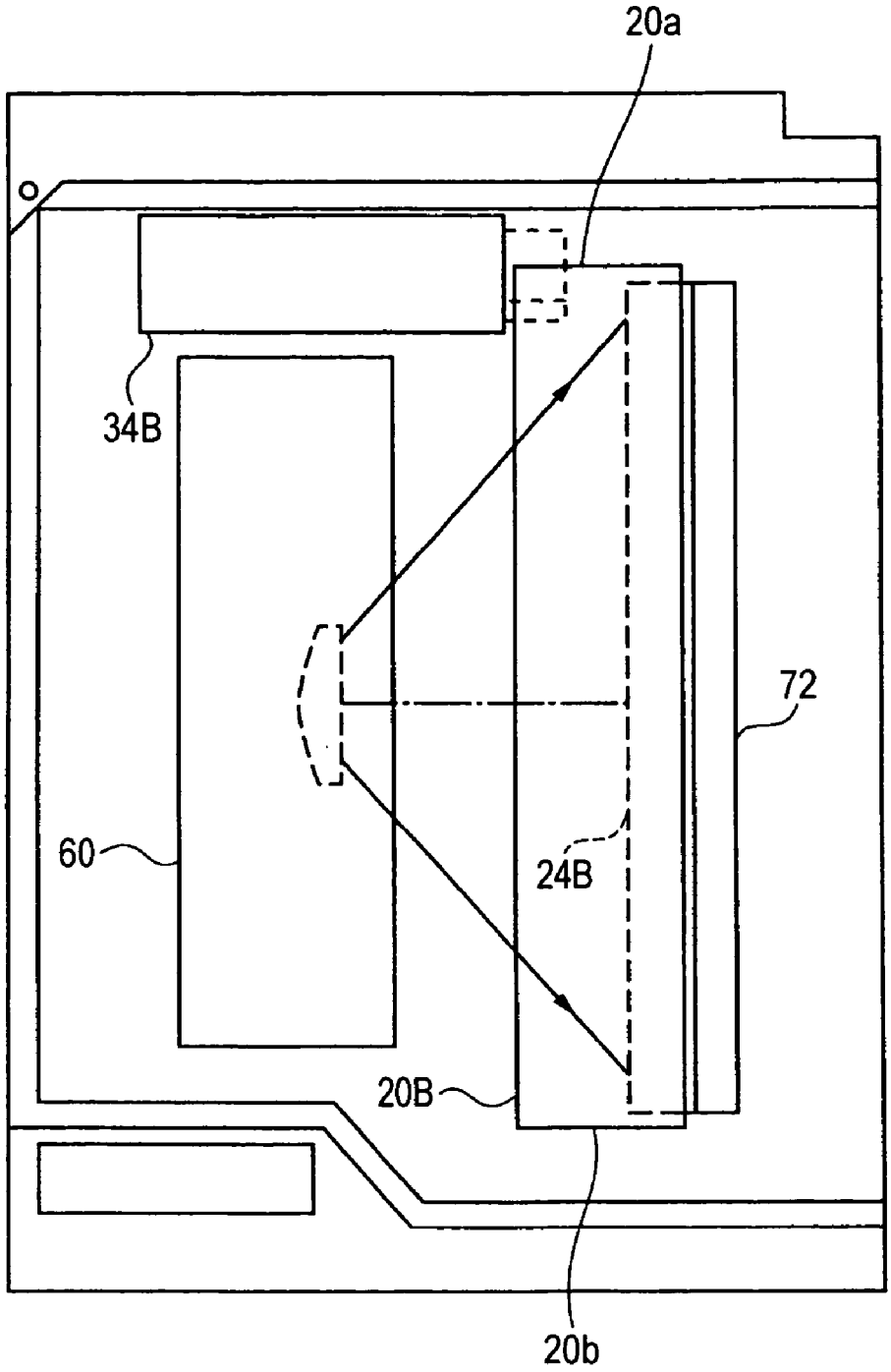
FIG. 2 is an explanatory view illustrating the image forming apparatus according to the first embodiment of the invention and also schematically illustrating a cross-section taken along line A-A shown in FIG. 1.

As shown in FIG. 2, the developer tank 34 is disposed so that at least a part of the developer tank 34 is placed between one end portion 20*a* and the other end portion 20*b* in the longitudinal direction of the image forming unit 20. Although the developer tank 34 is disposed in this embodiment so that apart of the developer tank 34 is placed between the one end portion 20*a* and the other end portion 20*b*, the developer tank 34 may be disposed so that the entirety of the developer tank 34 is placed between the one end portion 20*a* and the other end portion 20*b*. The image forming apparatus 10 can be prevented by disposing the developer tank 34 in this manner from being enlarged in the longitudinal direction of the image forming unit 20.

The developer tank 34 is disposed at the end portion 20*a* in the longitudinal direction of the image forming unit 20 or disposed in the vicinity of the end portion 20*a*. Thus, a substantial space can be assured at a part other than the end portion 20*a* in the longitudinal direction of the image forming unit 20. The image forming apparatus can be miniaturized by placing another member in this space. Although the optical writing device 60 (to be described later) is disposed in the space formed by placing the developer 34 at the end portion 20*a* of the image forming unit 20 in this embodiment, another member may be placed in this space. The developer tank 34 is disposed so that a longitudinal direction thereof is substantially perpendicular to the longitudinal direction of the image forming unit 20.

As shown in FIG. 1, the developer tank 34 is disposed so that at least a part thereof overlaps with the image forming unit 20 in a horizontal direction. Thus, the image forming apparatus can be miniaturized in the direction of a gravitational force, as compared with a case where, for instance, the developer tank 34 and the image forming unit 20 are configured not to overlap with each other in a horizontal direction, and where the developer tank 34 is provided higher than the image forming unit 20 in the direction of a gravitational force.

The developer tank 34 can be detachably attached to the image forming apparatus body 12. As previously described, the developer tank 34 is attached to and detached from the image forming apparatus body 12 through the opening portion 12*b* in a state in which the side cover 15 is opened.

The optical writing device 60 includes a laser exposure device and outputs laser light corresponding to a yellow image, laser light corresponding to a magenta image, laser light corresponding to a cyan image, laser light corresponding to a black image to the photoreceptors 24Y, 24M, 24C, and 24B, respectively, to thereby write an electrostatic latent image to each of the photoreceptors.

The laser light outputted from the optical writing device 60 reaches the photoreceptors 24 while spreading like a fan as shown in FIG. 2. Thus, the length of the optical writing device 60 in the longitudinal direction of the photoreceptor 24 is shorter than that of the photoreceptor 24. The aforementioned developer tank 34 and the optical writing device 60 are arranged along the longitudinal direction of the photoreceptor 24. Thus, the developer tank 34 is disposed in a space produced due to the difference between the length in the longitudinal direction of the photoreceptor 24 and the length in the same direction of the optical writing device 60. Consequently, the inside of the image forming apparatus body 12 can be miniaturized.

The transfer device 70 has a transfer device frame 71 formed integrally with the aforementioned front cover 14. Two support rolls 76*a* and 76*b*, a conveying belt 72, a sticking roll 74 used as a sticking mechanism that sticks a sheet onto the conveying belt 72, and transfer rolls 78Y, 78M, 78C, and 78B that respectively transfer developer images, which are formed on the photoreceptors 24Y, 24M, 24C, and 24B, onto a sheet, which is conveyed by the conveying belt 72, are mounted in the transfer device frame 71. The transfer device 70 opens or closes in cooperation with opening or closing of the aforementioned front cover 14, and brings the opening portion 12*a* of the image forming apparatus body 12 into an opened state or a closed state.

Between the two support rolls 76*a* and 76*b*, the support roll 76*a* is connected to a motor (not shown) serving as a drive force source. The support roll 76*a* is used as a drive roll that rotates and to rotate and drive the conveying belt 72. The support roll 76*b* is used as a driven roll that rotates with the rotation of the conveying belt 72.

The conveying belt 72 conveys a sheet supplied from a resist roll 86 (to be described later) to the fixation device 64 and is tightly stretched in a longitudinal direction.

The sticking roll 74 is provided in a state in which the sticking roll 74 is press-contacted with the support roll 76*b* through the conveying belt 72. A voltage is applied from a power supply (not shown) to the sticking roll 74 that causes a sheet to stick to the conveying belt 72 in an electrostatic manner.

A transfer bias voltage is applied to each of the transfer rolls 78Y, 78M, 78C, and 78B. Thus, developer images formed on the photoreceptors 24Y, 24M, 24C, and 24B are sequentially transferred onto the sheet, which is conveyed by the conveying belt 72. Thus, a color developer image is formed on the sheet by superposing four color developer images, that is, yellow, magenta, cyan, and black developer images.

The fixation device 64 includes a heating roll 64*b* and a pressure roll 64*a*. A sheet passing through between the heating roll 64*a* and the pressure roll 64*b* is heated and is pressurized to thereby fix the developer image onto the sheet.

The sheet supply/conveyance system 80 has a sheet supply cassette 82, a main conveying path 88 on which a sheet is conveyed in a case where an image is formed mainly and only one surface of the sheet, and a reverse conveying path 90 on which a sheet is conveyed only in a case where images are formed on both sides of the sheet.

The sheet supply cassette 82 can be detached from the image forming apparatus body 12, and accommodates a sheet, such as a sheet of plain paper and an OHP-sheet, to be used as an element onto which an image is transferred. A pickup roll 84 used to pick up a sheet from the sheet supply cassette 82, a conveying roll 85 used to convey the sheet, which is picked up by the pickup roll 84, along the main conveying path 88, and a retard roll 87 that sorts sheets in cooperation with the conveying roll 85 are disposed in the vicinity of the sheet supply cassette 82.

The main conveying path 88 is a conveying path on which a sheet supplied from the sheet supply cassette 82 is conveyed to a discharging portion 13 through the aforementioned image forming portion 16. The conveying roll 85, the retard roll 87, the resist roll 86, the aforementioned conveying belt 72, the fixation device 64, and the discharging roll 89 are disposed along the main conveying path 88 from an upstream side in a direction in which a sheet is conveyed.

The reverse conveying path 90 is a conveying path through which a sheet having a surface, on which an image is formed by the image forming portion 16, is conveyed to the image forming portion 16 while the sheet is being reversed. The reverse conveying path 90 is provided on the aforementioned front cover 14. The sheet, on the front side of which an image is formed, is led to the reverse conveying path 90 by the reverse rotation of the discharging roll 89. Further, the sheet is conveyed by the reverse conveying roll 92 disposed along the reverse conveying path 90. Then, the sheet is conveyed to the image forming portion 16 through the resist roll 86. An image is formed on the rear side of the sheet reversed by the reverse conveying path 90. Thus, images are formed on both sides of the sheet, respectively.

The movement mechanism 100 is used as the movement mechanism that moves at least one of the image forming unit 20 and the developer tank 34 so that each of the image forming unit 20 and the developer tank 34 is disposed not to hinder the other from being taken out of the image forming apparatus body 12. As described above, the developer tank 34 is disposed so that at least a part of the developer tank 34 is placed between one end portion 20*a* and the other end portion 20*b* in the longitudinal direction of the image forming unit 20 (see FIG. 2). Thus, when the developer tank 34 is drawn out of the image forming apparatus body 12 in the direction of the image forming unit 20, that is, rightwardly, as viewed in FIG. 2, the developer tank 34 is obstructed by the image forming unit 20. Thus, in this embodiment, the movement mechanism 100 moves the developer tank 34 to a position, at which the image forming unit 20 does not hinder the developer tank 34 from being taken out of the image forming apparatus body 12, to thereby enable the developer tank 34 to be taken out of the image forming apparatus body 12 in the direction of the image forming unit 20. This removes the constraint imposed on the layout, that is, the constraint that the developer tank 34 should be disposed so that no part of the developer tank 34 is placed between the one end portion 20*a* and the other end portion 20*b* of the image forming unit 20. Consequently, the image forming apparatus 10 can be miniaturized.

Figure 9:
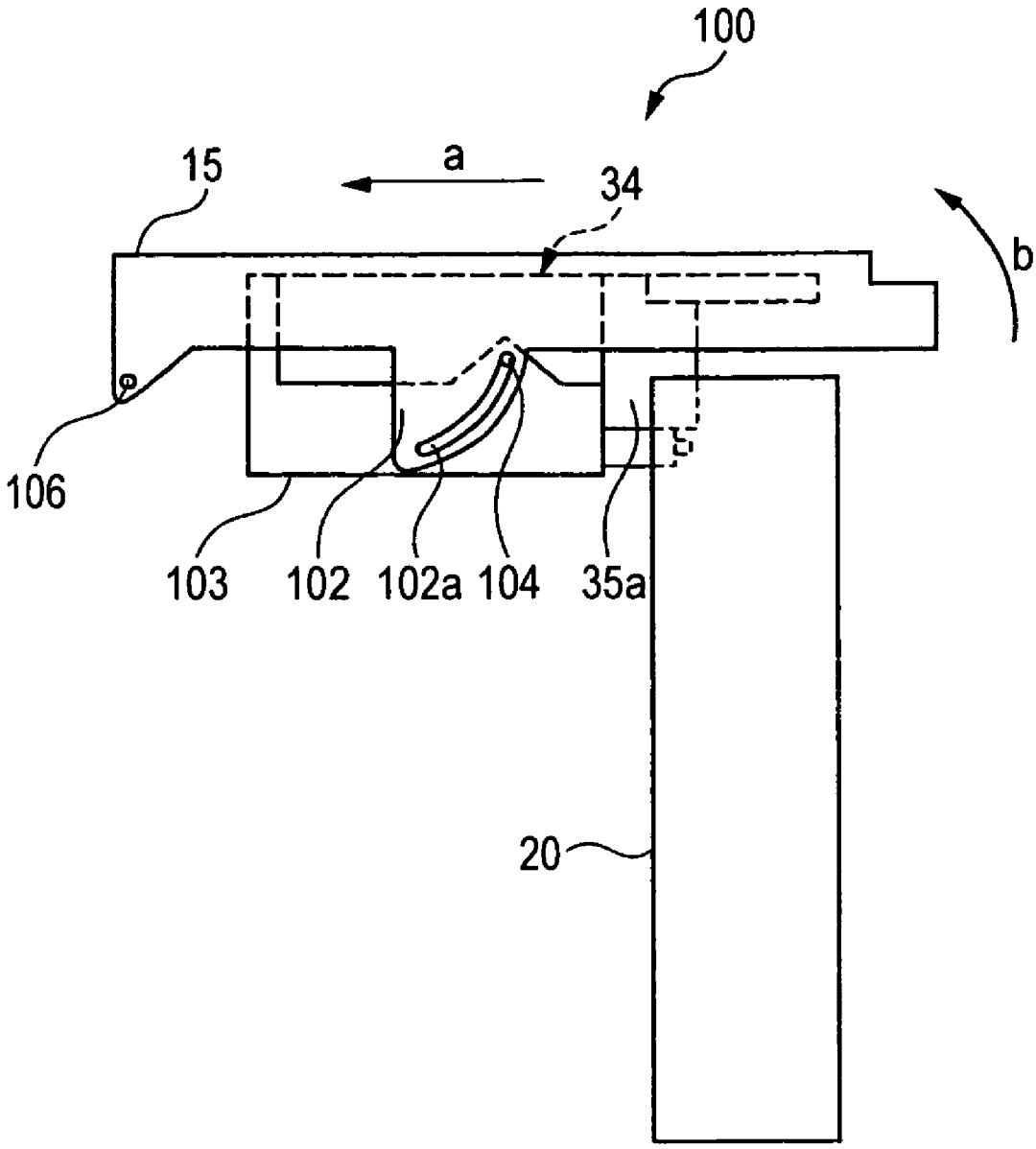
FIG. 9 is a first explanatory view illustrating an operation of a movement mechanism of the image forming apparatus according to the first embodiment of the invention.
Figure 10:
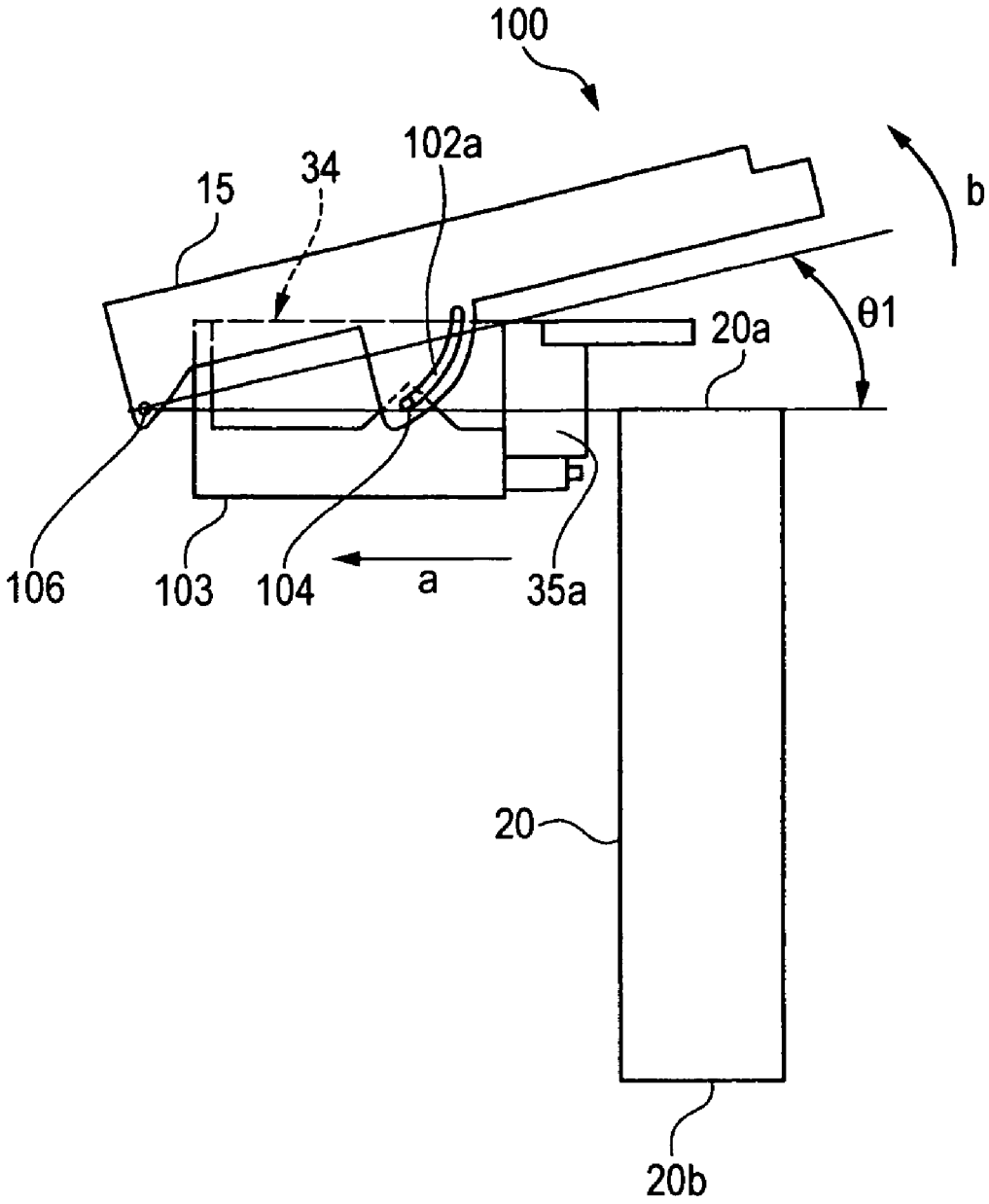
FIG. 10 is a second explanatory view illustrating the operation of the movement mechanism of the image forming apparatus according to the first embodiment of the invention.
Figure 11:
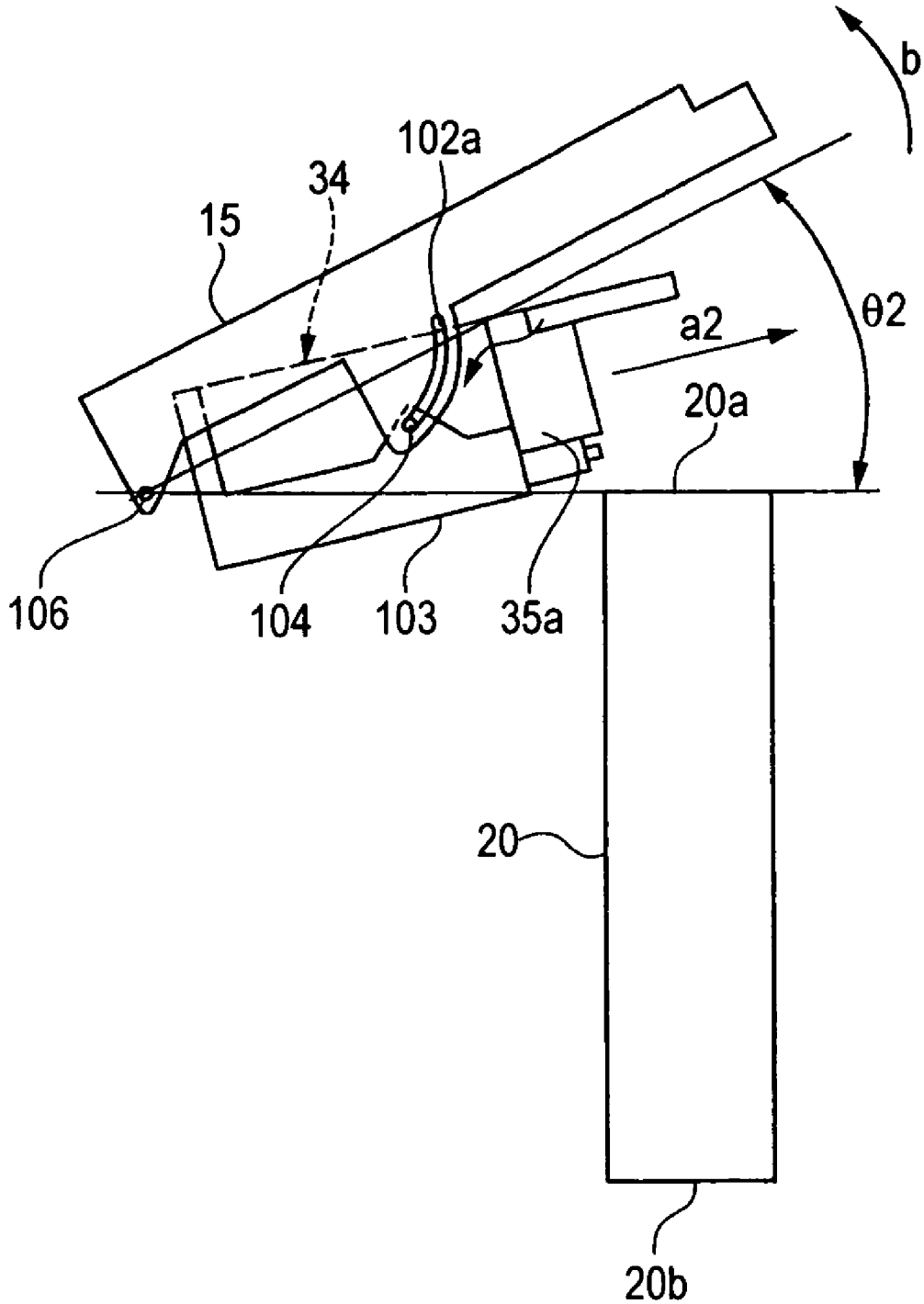
FIG. 11 is a third explanatory view illustrating the operation of the movement mechanism of the image forming apparatus according to the first embodiment of the invention.

As shown in FIGS. 9 to 11, the movement mechanism 100 has a groove portion 102*a* serving as a cam provided in the protrusion portion 102 formed integrally with a part of the aforementioned side cover 15, which part is provided at the side of the image forming unit 20, and also has a guide member 103 used as a guide mechanism that guides the movement of the developer tank 34 engaged with the side cover 15. The movement mechanism 100 also has a projection portion 104 that is provided at the guide member 103 and that engages with the groove portion 102*a*. The guide member 103 is provided slidably on the side cover 15 in a direction of an arrow a shown in FIG. 9. The guide member 103 slides on the side cover 15 in a state in which the guide member 103 holds the developer tank 34, to thereby guide the movement of the developer tank 34. The side cover 15 is freely openably and closeably supported by the support shaft 106 used as a support portion provided in the image forming apparatus body 12. The side cover 15 opens and closes in a state in which the guide member 103 is provided therein.

When the side cover 15 is opened to a second position shown in FIG. 10 by an angle θ1 from a first position shown in FIG. 9, at which the side cover 15 is closed, the movement mechanism 100 cooperates with this opening operation of the side cover 15 and disconnects the image forming unit 20 and the developer tank 34. That is, when the side cover 15 is opened in the direction of an arrow b shown in FIG. 9, the groove portion 102*a* functioning as a cam pushes the projection portion 104, which is provided on the guide member 103, in the direction of an arrow a. Thus, this pushing causes the guide member 103 to move along the side cover 15 in the direction of the support shaft 106 (that is, the direction of the arrow a shown in FIG. 9) together with the developer tank 34 while maintaining a state in which the guide member 103 holds the developer tank 34. This movement changes the state, in which the protrusion portion 35*a* of the developer tank casing 35 is inserted into the opening portion 21*e* provided in the image forming unit 20 (see FIG. 7), to a state in which the image forming unit 20 and the developer tank 34 are disconnected. Thus, the movement mechanism 100 moves at least one of the image forming unit 20 and the developer tank 34 to thereby disconnect the image forming unit 20 and the developer tank 34.

When the side cover 15 is opened to a third position shown in FIG. 11 by an angle θ2 from the second position shown in FIG. 10, the movement mechanism 100 cooperates with this opening of the side cover 15 and moves the developer tank 34 to a position at which at least a part of the developer tank 34 is drawn out of the image forming apparatus body 12. That is, when the side cover 15 is opened in the direction of the arrow b shown in FIG. 10, the projection portion 104 provided at the guide member 103 is subject to a force exerted from the groove portion 102*a*. Thus, the guide member 103 rotates in the direction of the arrow b together with the side cover 15 by maintaining a state in which the guide member 103 holds the developer tank 34. Then, this rotation causes the part of the developer tank 34, which part is provided at the side of the side cover 15, to move to a position at which this part of the developer tank 34 is drawn out of the image forming apparatus body 12. Additionally, in a state illustrated in FIG. 10, the end portion of the developer tank 34, which portion is provided at the side of the image forming unit 20, is placed outside the one end portion 20*a* and the other end portion 20*b* in the longitudinal direction of the image forming unit 20. Then, the developer tank 34 is taken out of the image forming apparatus body 12 by drawing out the developer tank 34 in the direction of an arrow a2 shown in FIG. 11 in a state in which the developer tank 34 moves to a position shown in FIG. 11. Incidentally, when the developer tank 34 is taken out, the guide member 103 remains attached to the side cover 15. Thus, the guide member 103 having held the developer tank 34 is disconnected therefrom.

Next, an operation of the aforementioned embodiment is described below.

When an image forming operation is started, the surface of each of the photoreceptors 24 is uniformly electrified by the electrification device 26. Thus, a latent image is formed on each of the photoreceptors 24 due to light outputted from the optical writing device 60. Then, the latent image formed on each of the photoreceptors 24 by the optical writing device 60 is developed by the development device 28 to produce a developer image.

On the other hand, a sheet accommodated in the sheet supply cassette 82 of a sheet supply device is picked up by the pickup roll 84 and is then conveyed to the resist roll 86. Subsequently, the sheet is tentatively stopped at the resist roll 86. Then, the sheet is led to the conveying belt 72 with appropriate timing. Subsequently, the developer image formed on each of the photoreceptors is transferred onto this sheet by an associated one of the transfer rolls 78Y, 78M, 78C, and 78B. Thus, a developer image obtained by superposing a yellow developer image, a magenta developer image, a cyan developer image, and a black developer image is formed on the sheet. Then, the sheet, on which the developer image is formed, is delivered to the fixation device 64. After the fixation of the developer image is performed at the fixation device 64, the sheet is discharged by the discharging roll 89 to the discharging portion 13.

In a case where the image forming unit 20 is attached to or detached from the image forming apparatus body 12 so as to, for example, replace the image forming unit 20 with a new one when the image forming operation is performed, first, the front cover 14 is opened so that the opening portion 12*a* is put into an opened state. Then, the image forming unit 20 is attached thereto or detached therefrom through the opening portion 12*a*. In a case where the developer tank 34 is attached to and detached from the apparatus body, first, the side cover 15 is opened. Then, the image forming unit 20 and the developer tank 34 is disconnected by the movement mechanism 100 that cooperates with the opening of the side cover 15. Subsequently, the movement mechanism 100 moves the developer tank 34 to a position at which the image forming unit 20 does not hinder the developer tank 34 from being taken out of the image forming apparatus body 12. At this position, the developer tank 34 is taken out of the image forming apparatus body 12 by using the handle 36. At that time, the developer tank 34 moves in a direction indicated by the arrow a shown in FIG. 8, in which the developer tank 34 goes away from the image forming unit 20. Thereafter, the developer tank 34 rotates around the support shaft 106 (see FIG. 9) as indicated by the arrow b in FIG. 8. Subsequently, the developer tank 34 is drawn out of the image forming apparatus body 12 in the direction of the arrow c shown in this figure. Then, the direction indicated by the arrow c shown in FIG. 8, in which the developer tank 34 is taken out of the image forming apparatus body 12, is substantially the same as the direction indicated by the arrow d shown in this figure, in which the image forming unit 20 is taken out of the image forming apparatus body 12.

Figure 12:
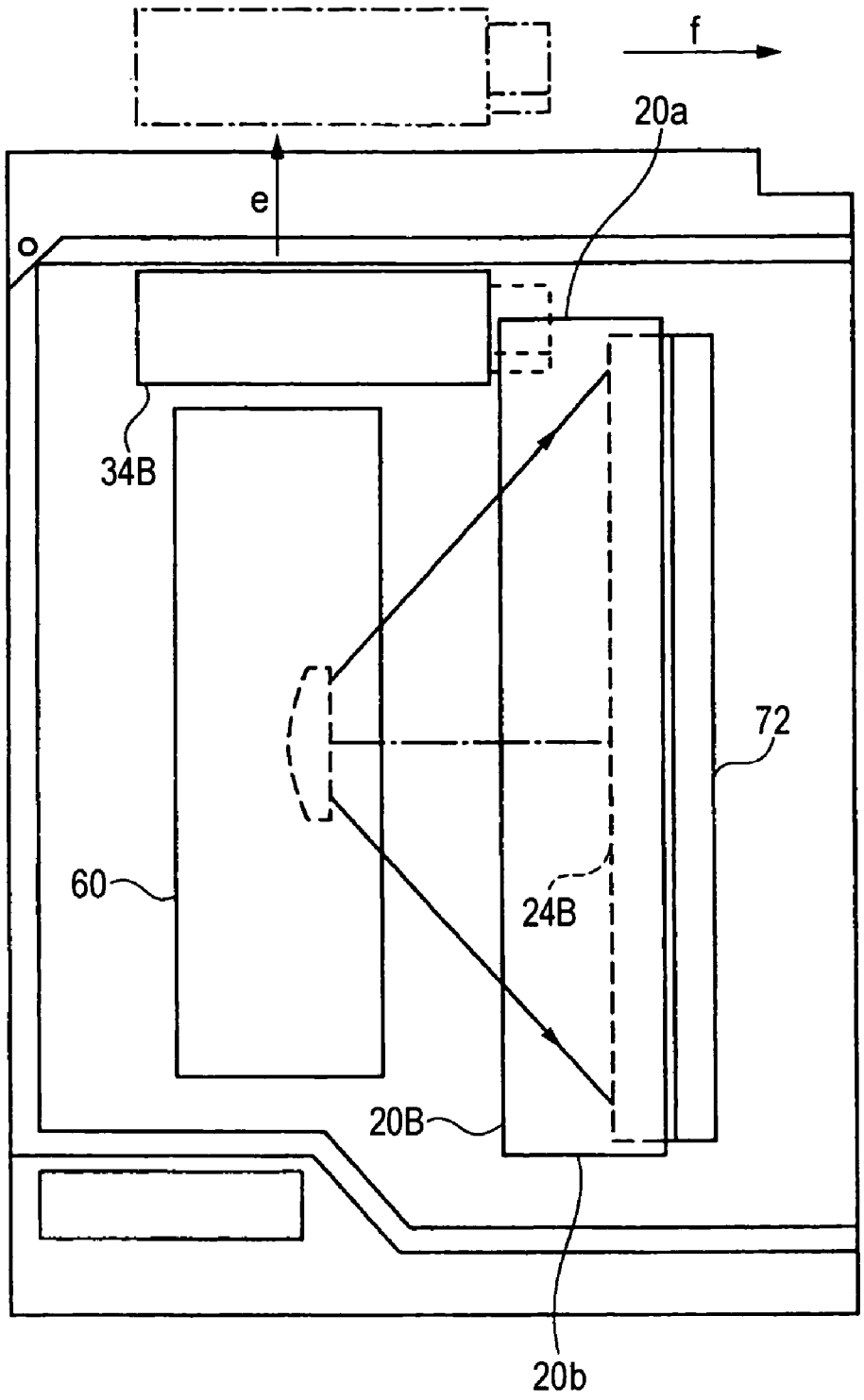
FIG. 12 is an explanatory view illustrating a state in which a developer tank is taken out of an image forming apparatus according to a second embodiment of the invention.
Figure 13:
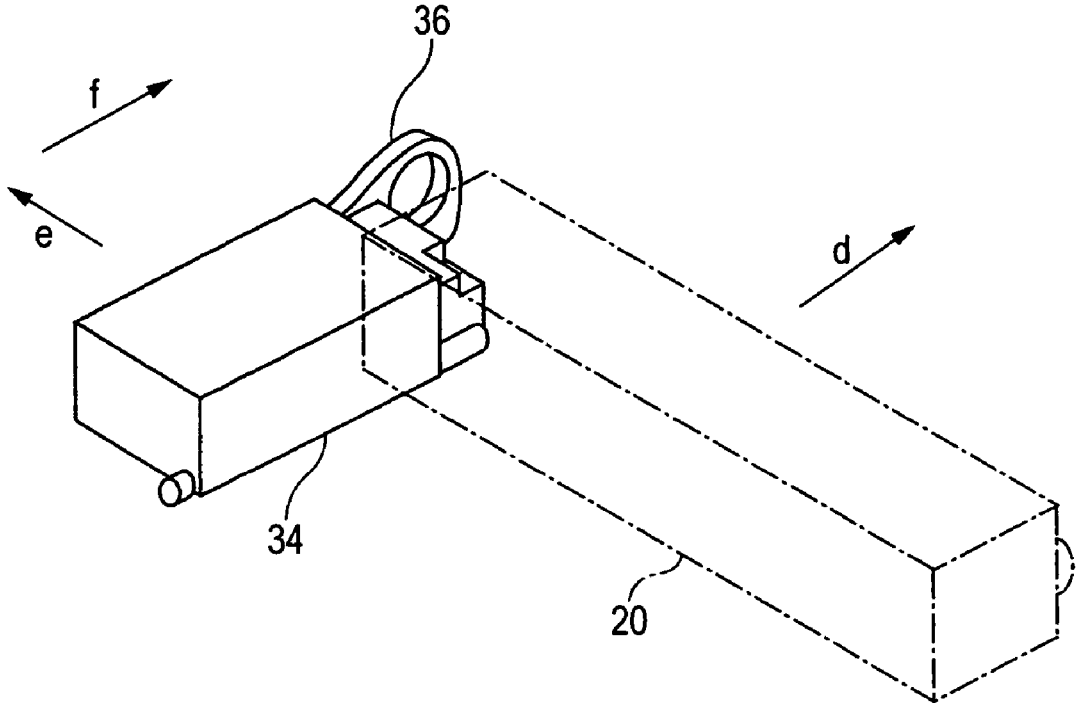
FIG. 13 is an explanatory view illustrating a state in which an image forming unit and the developer tank are taken out of the image forming apparatus according to the second embodiment of the invention.

FIGS. 12 and 13 illustrate a second embodiment of the image forming apparatus 10. As compared with the first embodiment in which the developer tank 34 is turned around the support shaft 106 so that the end portion of the developer tank 34, which portion is provided at the side of the image forming unit 20, is placed outside the one end portion 20*a* and the other end portion in the longitudinal direction of the image forming unit 20. In the second embodiment, the developer tank 34 is moved in the longitudinal direction of the image forming unit 20, which is indicated by an arrow e shown in FIG. 12 so that no part of the developer tank 34 is placed between the one end portion 20*a* and the other end portion 20*b* in the longitudinal direction of the image forming unit 20. Additionally, in the second embodiment, a direction, in which the developer tank 34 is taken out of the image forming apparatus body 12, is substantially perpendicular to a longitudinal direction of the image forming unit 20, which is indicated by an arrow f shown in FIG. 13. The direction indicated by the arrow f, in which the developer tank 34 is taken out of the image forming apparatus body 12, is substantially the same as the direction indicated by the arrow d, in which the image forming unit 20 is drawn out of the image forming apparatus body 12.

As described above, the invention can be applied to image forming apparatuses, such as copying machines, facsimiles, and printers.

The entire disclosure of Japanese Patent Application 2005-274965 on Sep. 22, 2005 including specification, claims, drawings and abstract is incorporated herein by reference in its entirely.

What is claimed is:

1. An image forming apparatus comprising:

an image forming apparatus body;

a first unit detachably attached to the image forming apparatus body;

a second unit detachably attached to the image forming apparatus body; and a movement mechanism that moves at least one of the first unit and the second unit to satisfy the condition that each of the first unit and the second unit is disposed not to hinder the other from being attached to and detached from the image forming apparatus body;

wherein the first unit has a development device and the second unit has a developer accommodating portion in which a developer to be supplied to the development device is accommodated;

wherein the image forming apparatus body has an opening portion with which at least one of the first unit and the second unit is attached and detached and an opening/closing cover that opens and closes the opening, and wherein the movement mechanism cooperates with the opening of the opening/closing cover, and wherein the second unit is connected to the first unit, and the movement mechanism moves at least a part of the second unit to a position at which the part of the second unit is drawn out of the image forming apparatus body, after moving the second unit cooperating with the opening of the opening/closing cover to disconnect the second unit from the first unit.

2. The image forming apparatus according to claim 1, wherein the second unit is connected to the first unit, and the movement mechanism moves at least one of the first unit and the second unit, and disconnects the second unit from the first unit.

3. The image forming apparatus according to claim 1, wherein the second unit is disposed at the position that a longitudinal direction of the second unit is substantially perpendicular to a longitudinal direction of the first unit, and wherein the movement mechanism activates the second unit to turn around a support portion provided at the image forming apparatus body in a condition that an end portion of the second unit, which portion is provided at a side of the first unit, is placed outside one end portion and the other end portion in the longitudinal direction of the first unit.

4. The image forming apparatus according to claim 1, wherein the second unit is disposed at a position that a longitudinal direction of the second unit is substantially perpendicular to a longitudinal direction of the first unit; and wherein the movement mechanism activates the second unit to move in the longitudinal direction of the first unit in a condition that no part of the second unit is present between one end portion and the other end portion in the longitudinal direction of the first unit.

5. The image forming apparatus according to claim 1 wherein a direction, in which the first unit is taken out of the image forming apparatus body, is substantially same as a direction in which the second unit is taken out of the image forming apparatus body.

6. The image forming apparatus according to claim 1, wherein the second unit is disposed at a position that at least a part of the second unit is placed between one end portion and the other end portion in a longitudinal direction of the first unit with the second unit being mounted in the image forming apparatus body.

7. An image forming apparatus comprising:

an image forming apparatus body;

a first unit detachably attached to the image forming apparatus body;

a second unit detachably attached to the image forming apparatus body; and a movement mechanism that moves at least one of the first unit and the second unit to satisfy the condition that each of the first unit and the second unit is disposed not to hinder the other from being attached to and detached from the image forming apparatus body;

wherein the first unit has a developer removing device that removes a developer from a surface of an image carrying body and the second unit has a developer collecting portion that collects a developer removed by the developer removing device;

wherein the image forming apparatus body has an opening portion with which at least one of the first unit and the second unit is attached and detached and an opening/closing cover that opens and closes the opening, and wherein the movement mechanism cooperates with the opening of the opening/closing cover, and wherein the second unit is connected to the first unit, and the movement mechanism moves at least a part of the second unit to a position at which the part of the second unit is drawn out of the image forming apparatus body, after moving the second unit cooperating with the opening of the opening/closing cover to disconnect the second unit from the first unit.

8. The image forming apparatus according to claim 7, wherein the second unit is connected to the first unit, and the movement mechanism moves at least one of the first unit and the second unit, and disconnects the second unit from the first unit.

9. The image forming apparatus according to claim 7, wherein the second unit is disposed at the position that a longitudinal direction of the second unit is substantially perpendicular to a longitudinal direction of the first unit, and wherein the movement mechanism activates the second unit to turn around a support portion provided at the image forming apparatus body in a condition that an end portion of the second unit, which portion is provided at a side of the first unit, is placed outside one end portion and the other end portion in the longitudinal direction of the first unit.

10. The image forming apparatus according to claim 7, wherein the second unit is disposed at a position that a longitudinal direction of the second unit is substantially perpendicular to a longitudinal direction of the first unit; and wherein the movement mechanism activates the second unit to move in the longitudinal direction of the first unit in a condition that no part of the second unit is present between one end portion and the other end portion in the longitudinal direction of the first unit.

11. The image forming apparatus according to claim 7 wherein a direction, in which the first unit is taken out of the image forming apparatus body, is substantially same as a direction in which the second unit is taken out of the image forming apparatus body.

12. The image forming apparatus according to claim 7, wherein the second unit is disposed at a position that at least a part of the second unit is placed between one end portion and the other end portion in a longitudinal direction of the first unit with the second unit being mounted in the image forming apparatus body.

13. An image forming apparatus comprising:

an image forming apparatus body;

a first unit detachably attached to the image forming apparatus body;

a second unit detachably attached to the image forming apparatus body; and a movement mechanism that moves at least one of the first unit and the second unit to satisfy the condition that each of the first unit and the second unit is disposed not to hinder the other from being attached to and detached from the image forming apparatus body;

wherein the image forming apparatus body has an opening portion with which at least one of the first unit and the second unit is attached and detached and an opening/closing cover that opens and closes the opening, wherein the movement mechanism cooperates with the opening of the opening/closing cover;

wherein the second unit is connected to the first unit, and the movement mechanism moves at least a part of the second unit to a position at which the pad of the second unit is drawn out of the image forming apparatus body, after moving the second unit cooperating with the opening of the opening/closing cover to disconnect the second unit from the first unit;

wherein the movement mechanism axially moves at least the pad of the second unit to a position at which the part of the second unit is drawn out of the image forming apparatus body, after moving the second unit cooperating with the opening of the opening/closing cover to disconnect the second unit from the first unit.

14. The image forming apparatus according to claim 13, wherein, after the mechanism axially moves at least the part of the second unit to a position at which the part of the second unit is drawn out of the image forming apparatus body, the moving mechanism moves at least the part of the second unit along with the cover to another position.

15. The image forming apparatus according to claim 14, when the moving mechanism moves at least the part of the second unit along with the cover to another position, at least the part of the second unit is rotated.

* * * * *